US006335715B1

(12) United States Patent
Lee

(10) Patent No.: US 6,335,715 B1
(45) Date of Patent: Jan. 1, 2002

(54) CIRCUIT FOR PREVENTING RUSH CURRENT IN LIQUID CRYSTAL DISPLAY

(75) Inventor: Sang Tae Lee, Kyungsangbuk-Do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/353,932

(22) Filed: Jul. 15, 1999

(30) Foreign Application Priority Data

Nov. 6, 1998 (KR) ..... 98-47566

(51) Int. Cl.[7] ..... G09G 3/30

(52) U.S. Cl. ..... 345/87; 345/98; 345/99; 345/100; 345/211; 345/213; 345/214

(58) Field of Search ..... 345/87, 98, 99, 345/100, 211, 213, 204, 206, 214

(56) References Cited

U.S. PATENT DOCUMENTS

| | | | | |
|---|---|---|---|---|
| 4,495,626 A | | 1/1985 | Brunin et al. | 375/19 |
| 4,731,797 A | | 3/1988 | Jaffre et al. | 375/19 |
| 5,726,677 A | * | 3/1998 | Imamura | 345/99 |
| 5,748,902 A | | 5/1998 | Dalton et al. | 395/200 |
| 5,917,364 A | | 6/1999 | Nakamura | 327/415 |
| 6,040,828 A | * | 3/2000 | Park | 345/213 |
| 6,124,840 A | * | 9/2000 | Kwon | 345/100 |

FOREIGN PATENT DOCUMENTS

| | | |
|---|---|---|
| EP | 0 069 183 | 6/1981 |
| EP | 0 228 528 | 10/1986 |
| EP | 0 872 793 | 10/1998 |
| JP | 07-199148 | 8/1995 |
| JP | 08-304773 | 11/1996 |
| JP | 09-233146 | 9/1997 |
| JP | 10-190751 | 7/1998 |
| WO | WO 92/09162 | 5/1992 |
| WO | WO 97/13347 | 4/1997 |
| WO | WO 97/13348 | 4/1997 |

OTHER PUBLICATIONS

United Kingdom Patent Office Search Report dated Oct. 12, 1999.

Korean Patent Office Search Report dated Sep. 28, 2000.

* cited by examiner

*Primary Examiner*—Richard Hjerpe
*Assistant Examiner*—Ali Zamani
(74) *Attorney, Agent, or Firm*—Long Aldridge & Norman LLP

(57) ABSTRACT

A rush current preventing circuit for a liquid crystal display that is suitable for eliminating a rush current at the time of applying an initial power to the liquid crystal display includes an output enable signal generator generating an output enable signal to control outputs of the gate drive integrated circuits. A start output enable signal generator generates a start output enable signal having at least a desired interval of disable pulse at the time of applying an initial power. An output enable signal switching device switches the output enable signal and the start output enable signal in accordance with the start output enable signal.

27 Claims, 2 Drawing Sheets

CIRCUIT FOR PREVENTING RUSH CURRENT IN LIQUID CRYSTAL DISPLAY

This application claims the benefit of Korean Patent Application No. 98-47566, filed on Nov. 6, 1998, which is hereby incorporated by reference.

BACKGROUND OF THE INVENTION

1. Field of the Invention

The present invention relates to a liquid crystal display, and more particularly, to a current preventing circuit for a liquid crystal display.

2. Description of the Related Art

A liquid crystal display (LCD) is, among other things, light weight, thin, and consumes low power. The LCD provides a highly enhanced picture quality owing to an improvement in a liquid crystal material and a development in the fine picture element (or pixel) treatment technique. Accordingly, the LCD has a wide range of applications. Such an LCD allows a picture corresponding to image signals to be displayed on a liquid crystal panel by controlling a light quantity passing through the liquid crystal panel based on the image signals. The liquid crystal panel of the LCD comprises a number of liquid crystal cells arranged in a matrix pattern, and a number of control switches such as thin film transistors (TFTs) for switching image signals to be applied to each liquid crystal cell. Further, the LCD includes a gate driver for driving the control switches. The gate driver consists of a plurality of gate drive integrated circuits, hereinafter referred to as "gate D-ICs".

For example, as shown in FIG. 1, the conventional LCD includes 1st to nth gate D-ICs 4*a*–4*n* for respectively driving gate lines in a liquid crystal panel 6. A timing controller 2 generates a row drive clock RCLK, a start pulse SP, and an output enable signal OE. The gate D-ICs 4*a*–4*n* respond to the start pulse from the timing controller 2 sequentially, and respond to the output enable signal OE and the row drive clock RCLK simultaneously. Each gate D-IC is provided with a shift register for shifting the start pulse SP by one bit in response to the row drive clock RCLK, and a level shifter array for level-shifting each logical signal at output channels from the shift register. The level shifter array responds to the output enable signal OE to apply the level-shifted signal to the gate line in the liquid crystal panel 6 as a scanning signal. Accordingly, the gate lines in the liquid crystal panel 6 are sequentially enabled for each horizontal synchronous interval by means of the gate D-ICs.

The gate D-ICs 4*a*–4*n* generate a rush current at the time of applying an initial power. This results from a reset function of the gate D-IC that is eliminated from the LCD to reduce the size of gate D-IC 4 and an error therein. More specifically, when an initial power is applied to the LCD, logical signals in an unknown state emerge at each output channel of the shift register included in the gate D-ICs 4. These unknown state logical signals change a high logic into a low logic or vice versa whenever the row drive clock RCLK is applied to the gate D-ICs 4*a*–4*n*. The unknown state logical signals are not eliminated until a ground logic of start signal is shifted into the last output channel of the last gate D-IC 4*n*. Further, the unknown state logical signals are applied to the gate lines in the liquid crystal panel 6 after being level-shifted with the level shifter array. At this time, specific logic states (e.g., high logic) of the logical signals are level-shifted, so that the level shifter array can be latched up. Also, since a number of gate lines are enabled, an overcurrent, called "rush current" having several hundred times the value as compared with a normal value, flows at the gate D-ICs 4*a*–4*n*. Such a rush current has an adverse effect on circuit devices within the LCD and gives rise to an abnormal operation in the circuit devices. This causes a deterioration in the LCD.

SUMMARY OF THE INVENTION

Accordingly, the present invention is directed to a circuit for preventing rush current in liquid crystal display that substantially obviates one or more of the problems due to limitations and disadvantages of the related art.

An object of the present invention is to provide a rush current preventing circuit for a liquid crystal display that is suitable for eliminating a rush current when an initial power is applied to the liquid crystal display.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a rush current preventing circuit for a liquid crystal display includes output enable signal generating means for generating an output enable signal to control outputs of gate drive integrated circuits; start output enable signal generating means for generating a start output enable signal having at least a desired interval of disable pulse at the time of applying an initial power; and output enable signal switching means for switching the output enable signal and the start output enable signal corresponding to the start output enable signal.

According to another aspect of the present invention, a rush current preventing circuit for a liquid crystal display includes start output enable signal generating means for generating a start output enable signal having at least a desired interval of disable pulse at the time of applying an initial power; and output enable signal combining means for combining an output enable signal with the start output enable signal and for applying the combined output enable signal to the gate drive integrated circuits.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiment of the present invention, example of which is illustrated in the accompanying drawings.

Figure 1:
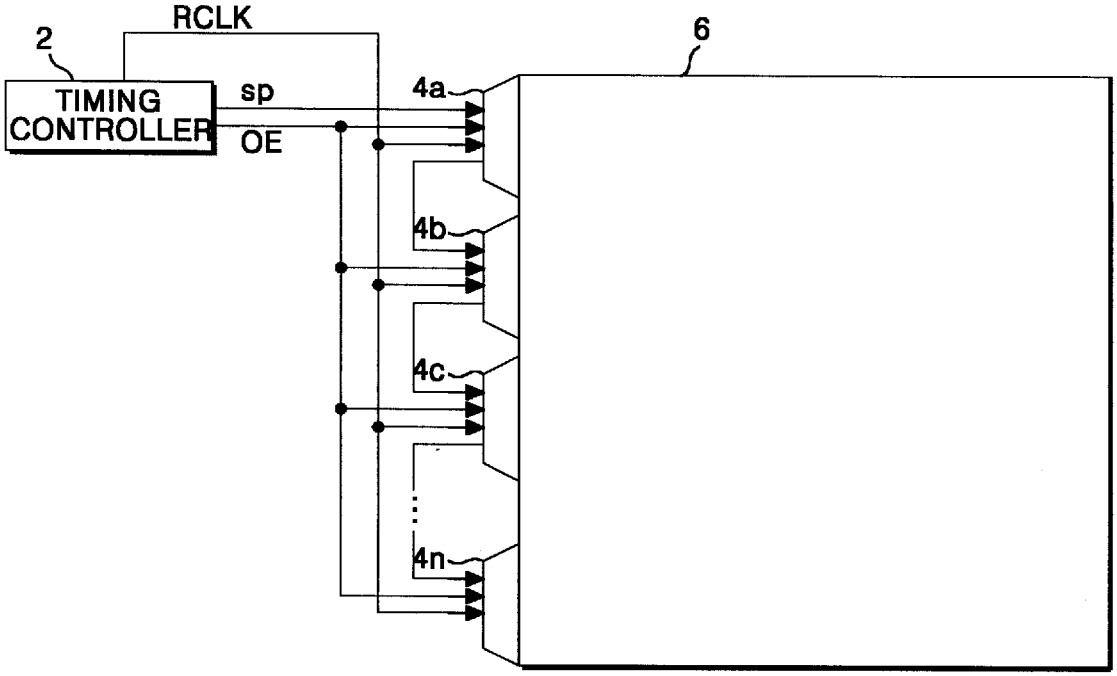
FIG.1 PRIOR ART
FIG. 1 is a schematic view showing the configuration of a conventional liquid crystal display.
Figure 2:
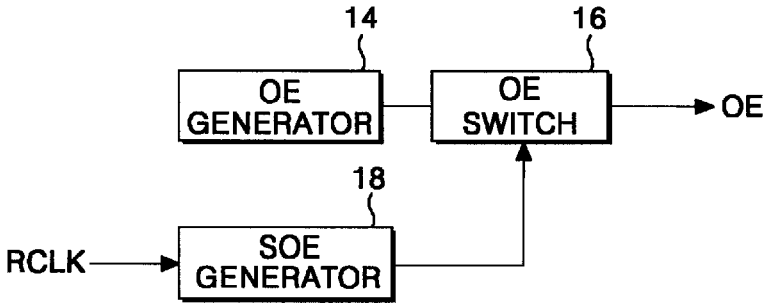
FIG. 2 is a block diagram of a rush current preventing circuit for a liquid crystal display according to an embodiment of the present invention.

Referring to FIG. 2, there is shown a rush current preventing circuit for a liquid crystal display according to an embodiment of the present invention. The rush current preventing circuit includes an output enable signal generator 14 for generating an output enable signal OE, a start output enable signal generator 18 for generating a start output enable signal SOE, and an output enable signal switch 16 for combining the start output enable signal SOE from the start output enable signal generator 18 with the output enable signal OE from the output enable signal generator 14. The output enable signal generator 14, the start enable signal generator 18, and the output enable signal switch 16 are preferably included in a timing controller such as shown in FIG. 1. In this case, the output enable signal switch 16 is commonly connected to the gate D-ICs 4*a*–4*n* shown in FIG. 1 to apply any one of the output enable signal OE and the start output enable signal SOE to the gate D-ICs 4*a*–4*n*. The output enable signal OE generated at the output enable signal generator 14 has an enable pulse of low logic designating a time interval at which a scanning signal is output from the gate D-IC to a gate line in the liquid crystal panel 6 every horizontal synchronous interval. The start output enable signal SOE has a disable pulse of high logic which prevents a scanning signal from being applied from the gate D-IC to the gate line in the liquid crystal panel 6 during at least one vertical synchronous interval, preferably during an interval of 20 ms. This disable pulse is generated at a time point when power is applied to the LCD, or after a certain time from the time point. In order to generate the start output enable signal SOE, the start output enable signal generator 18 may include a counter for counting a row drive clock RCLK to set a width of the disable pulse, and a logical arithmetic unit for generating a logical signal from an output of the counter. An R-C integrator having resistors and capacitors can be used as the counter. A switching device or a comparator having a threshold voltage, such as a field effect transistor and the like, can be used as the logical arithmetic unit. The output enable signal switch 16 allows the start output enable signal SOE from the start output enable signal generator 18 to be applied to the gate D-ICs 4*a*–4*n* during a time interval when the start output enable signal SOE has a high logic of disable pulse. On the other hand, the output enable signal switch 16 allows the output enable signal OE from the output enable signal generator 14 to be transferred to the gate D-ICs 4*a*–4*n* during a time interval when the start output enable signal SOE does not have a high logic of disable pulse. To this end, the output enable signal switch 16 can include one control switch or two three-state buffers. Alternatively, the output enable signal switch 16 may include a logic gate, such as an OR gate, or a wired logic gate.

The gate D-ICs 4*a*–4*n* connected to the output enable signal switch 16 commonly respond to the start output enable signal SOE upon power-on. At this time, the level shifter array included in each gate D-IC does not output a scanning signal to the gate line in the liquid crystal panel 6 during at least one of vertical synchronous interval by a disable pulse of the start output enable signal SOE. Meanwhile, the shift register included in each the gate D-IC is initialized by shifting a ground logic state as a start signal with the aid of a row drive pulse. Accordingly, the level shifter array is not latched up even though the output enable signal OE is applied. Thus, a rush current is not generated at the gate D-ICs 4*a*–4*n*. As a result, circuit devices within the LCD operate under stable conditions and the LCD performance is improved dramatically.

Figure 3:
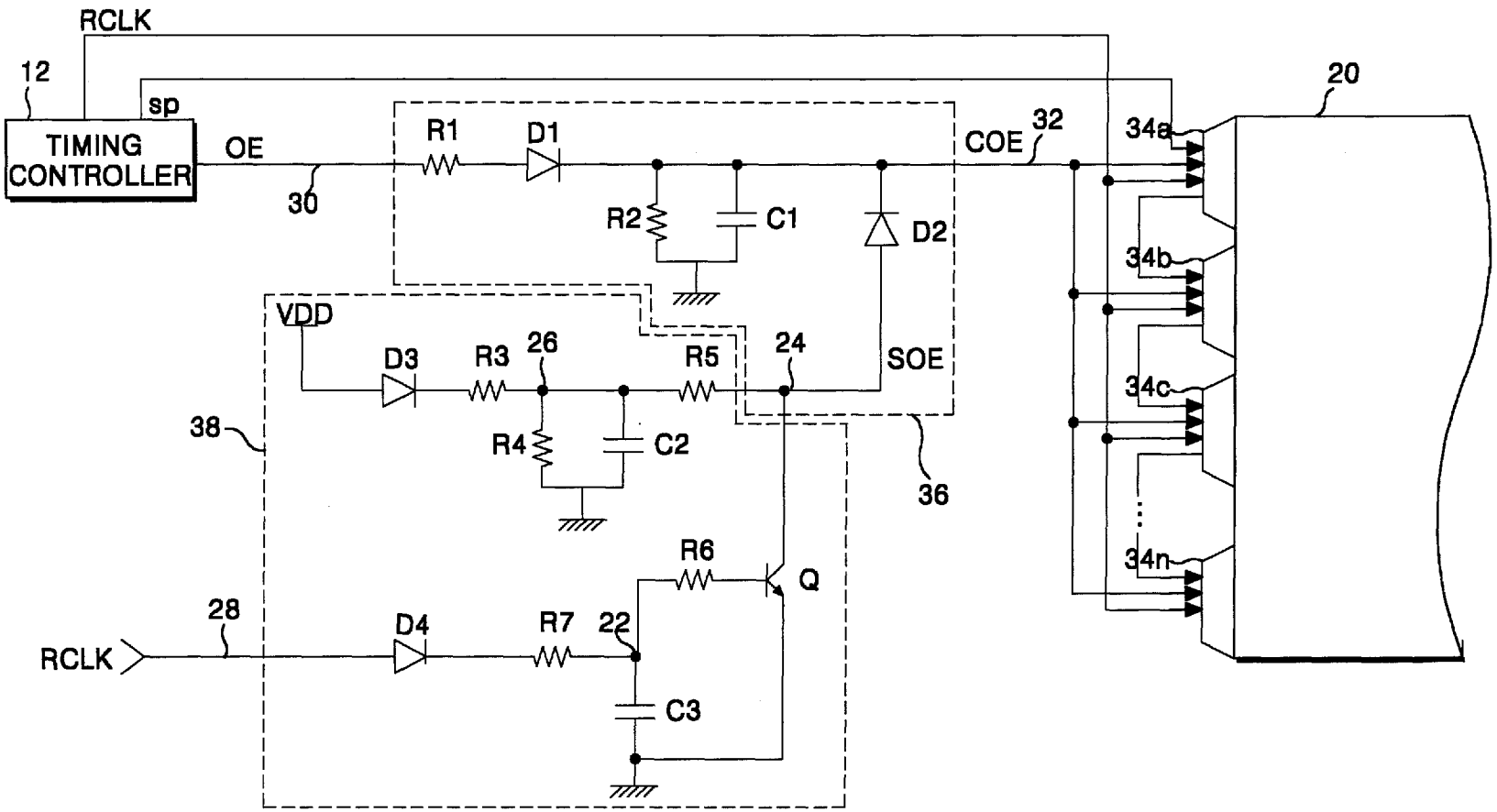
FIG. 3 shows a rush current preventing circuit for a liquid crystal display according to another embodiment of the present invention.

Referring now to FIG. 3, there is shown a rush current preventing circuit for a liquid crystal display according to another embodiment of the present invention. The rush current preventing circuit includes a start output enable signal generator 38 for generating a start output enable signal SOE, and an output enable signal combiner 36 for combining an output enable signal OE from a timing controller 12 with the start output enable signal SOE from the start output enable signal generator 38. The rush current preventing circuit preferably includes an exterior block separated from the timing controller 12, and which is connected between the output terminal of the timing controller 12 and the input terminals of gate D-ICs 34(*a*–*n*) in the liquid crystal panel. In this case, the output terminal of the timing controller 12 is connected to a signal input line 30 of the rush current preventing circuit. A combined output enable signal COE generated at the output enable signal combiner 36 is commonly applied, via an output line 32, to the gate D-ICs 34.

Specifically, the start output enable signal generator 38 includes a fourth diode D4 and a seventh resistor R7 connected in series between a clock input line 28 and a first node 22, a third capacitor C3 connected between the first node 22 and a ground voltage source GND, a transistor Q having an emitter terminal and a collector terminal connected to the ground voltage source GND and a second node 24, respectively, and a sixth resistor R6 connected between the first node 22 and the base terminal of the transistor Q. The seventh resistor R7 and the third capacitor C3 is used as an R-C integrator which integrates a row drive clock signal RCLK from a clock input line 28. The transistor Q is a switching device having a desired threshold voltage which generates a logical signal from an output signal of the R-C integrator. More specifically, the R-C integrator accumulates the row drive clock signal RCLK inputted via a fourth diode D4 from the clock input line 28. Such an accumulating operation in the R-C integrator occurs because a voltage charged in the third capacitor C3 is prevented from being discharged into the clock input line 28 by the fourth diode D4. A time constant of the R-C integrator is set such that a voltage charged in the third capacitor C3 arrives at the threshold voltage of the transistor Q after the lapse of at least one vertical synchronous interval, preferably an interval of 20ms, from the time of power-on. In other words, the R-C integrator performs a counter function of counting one vertical synchronous interval from the time of power-on. The transistor Q compares a voltage level accumulated in the R-C integrator (i.e., the third capacitor C3) with its threshold voltage and switches a current path between the second node 24 and the ground voltage source GND in accordance with the compared result, whereby a logical signal emerges at the second node 24. When a voltage accumulated in the R-C integrator is higher than the threshold voltage of the transistor Q, the transistor Q is turned on to thereby bypass a voltage at the second node 24 into the ground voltage source GND. At this time, a start output enable signal SOE of a low logic state is generated at the second node 24. On the other hand, when a voltage accumulated in the R-C integrator is lower than the threshold voltage of the transistor Q, the transistor Q is turned off to thereby maintain a voltage at the second node 24. Thus, a start output enable signal SOE of a high logic state is generated at the second node 24. As a result, a start output enable signal SOE is generated at the second node where the SOE has a high logic state which acts as a disable pulse to prevent a scanning signal from being applied from the gate D-ICs 34 to the gate line in the liquid crystal panel 20 during at least one vertical synchronous interval, preferably an interval of 20 ms, from the time of power-on. Meanwhile, a sixth resistor R6 limits an over current applied to the base terminal of the transistor Q.

The start output enable signal generator 38 further includes a third diode D3 and a third resistor R3 connected in series between a supply voltage source VDD and a third node 26, a fourth resistor R4 and a second capacitor C2 connected in parallel between the third node 26 and the ground voltage source GND, and a fifth resistor R5 connected between the third node 26 and the second node 24. The supply voltage source VDD applies a supply voltage VDD having a certain voltage level, via the third diode D3 and the third resistor R3, to the third node 26. This supply voltage VDD is generated at the supply voltage source VDD after the lapse of a very short interval (e.g., a period of row drive clock signal) from a time of power-on. The third diode D3 prevents a voltage at the third node 26 from being reverse-applied to the supply voltage source VDD. The third and fourth resistors R3 and R4 and the second capacitor C2 constitute a low pass filter (LPF) which filters a supply voltage VDD to be applied from the third diode D3 to the fifth resistor R5. The LPF prevents a noise from being included in the supply voltage VDD transferred from the third diode D3 to the fifth resistor R5. The fifth resistor R5 limits a current flowing from the third node 26 into the second node 24. The supply voltage applied to the second node 24 is selectively bypassed into the ground voltage source GND with the aid of the transistor Q to generate the start output enable signal SOE.

The output enable signal combiner 36 includes a second diode D2 connected between the second node 24 and a signal output line 32, a first resistor R1 and a first diode D1 connected in series between the signal input line 30 and the signal output line 32, and a second resistor R2 and a first capacitor C1 connected in parallel between the signal output line 32 and the ground voltage source GND. The first resistor R1 limits the amount of current of the output enable signal OE that is to be transferred from the timing controller 12, via the signal input line 30, to the first diode D1. The first diode D1 passes the output enable signal OE from the first resistor R1 to the output signal line 32 and, at the same time, prevents a signal from being reverse-applied from the output signal line 32 to the first resistor R1. The second resistor R2 and the first capacitor C1 constitute a single LPF to eliminate a radio frequency (RF) noise component in the output signal line 32. The first diode D1 configures an OR gate along with the second diode D2. This OR gate combines the output enable signal OE with the start output enable signal SOE to generate a combined output enable signal COE. The combined output enable signal COE is commonly applied, via the output signal line 32, to the gate D-ICs 34. At this time, the level shifter array included in each gate D-IC 34 does not output to the gate line in the liquid crystal panel 20 during at least one vertical synchronous interval with the aid of a disable pulse of the start output enable signal SOE. The shift register included in each gate D-IC shifts a start signal of a ground logic state with the aid of a row drive pulse to thereby initialize the same. Accordingly, the level shifter array included in the gate D-IC 34 is not latched up even though the output enable signal OE is applied, and thus a rush current is not generated at the gate D-ICs 34. As a result, circuit devices within the LCD are operated under stable conditions and the reliability of the LCD is enhanced dramatically.

As described above, the rush current preventing circuit for the liquid crystal display according to the present invention generates the output enable signal having the disable pulse upon power-on, thereby preventing a scanning signal from being outputted at the gate line in the liquid crystal panel. Accordingly, a rush current is not generated at the liquid crystal display. As a result, the reliability of the liquid crystal display can be enhanced, and the liquid crystal display can perform a stable operation.

It will be apparent to those skilled in the art that various modifications and variation can be made in the circuit for preventing rush current in liquid crystal display of the present invention without departing from the spirit or scope of the invention. Thus, it is intended that the present invention cover the modifications and variations of this invention provided they come within the scope of the appended claims and their equivalents.

What is claimed is:

1. A rush current preventing circuit for a liquid crystal display having gate drive circuit coupled to a gate line comprising:

an output control signal generator producing an output enable signal to control outputs of the gate drive circuit;

an output enable signal switch coupled to the output control signal generator; and a start output control signal generator coupled to the output enable signal switch and generating a start output enable signal, wherein the output enable signal switch receives the output enable signal and the start output enable signal and controls the output of the output enable signal and the start output enable signal in accordance with the start output enable signal.

2. The rush current preventing circuit according to claim 1, wherein the output enable signal of the output control signal generator includes an enable pulse corresponding to a time interval of a scanning signal output from the gate drive circuit to the gate line of the liquid crystal display every horizontal synchronous interval.

3. The rush current preventing circuit according to claim 1, wherein the start output control signal of the start output control signal generator includes a disable pulse preventing a scanning signal output from the gate drive circuit to the gate line of the liquid crystal display during at least one vertical synchronous interval.

4. The rush current preventing circuit according to claim 3, wherein the disable pulse is generated from the start output control signal at a time when power is applied to the liquid crystal display.

5. The rush current preventing circuit according to claim 3, wherein the disable pulse is generated from the start output control signal after a predetermined time from a time when power is applied to the liquid crystal display.

6. The rush current preventing circuit according to claim 3, wherein the start output control signal generator includes:

a counter for setting a width of the disable pulse; and an arithmetic unit coupled to the counter for generating a logical signal from an output of the counter.

7. The rush current preventing circuit according to claim 6, wherein the counter includes an R-C integrator having resistors and capacitors.

8. The rush current preventing circuit according to claim 3, wherein the output control signal switch allows the start output control signal from the start output control signal generator to be applied to the gate drive circuit during a time interval when the start output control signal has the disable pulse.

9. The rush current preventing circuit according to claim 3, wherein the output control signal switch allows the output control signal from the output control signal generator to be transferred to the gate drive circuit during a time interval when the start output control signal has the disable pulse.

10. The rush current preventing circuit according to claim 3, wherein the output control signal switch allows the start output control signal from the start output control signal generator to be applied to the gate drive circuit during a time interval when the start output control signal has the disable pulse; and the output control signal switch allows the output control signal from the output control signal generator to be transferred to the gate drive circuit during a time interval when the start output control signal has the disable pulse.

11. The rush current preventing circuit according to claim 1, wherein the output enable signal of the output control signal generator includes an enable pulse corresponding to a time interval of a scanning signal output from the gate drive circuit to the gate line of the liquid crystal display every horizontal synchronous interval; and the start output control signal of the start output control signal generator includes a disable pulse preventing a scanning signal output from the gate drive circuit to the gate line of the liquid crystal display during at least one vertical synchronous interval.

12. The rush current preventing circuit according to claim 11, wherein the disable pulse is generated from the start output control signal at a time when power is applied to the liquid crystal display.

13. The rush current preventing circuit according to claim 11, wherein the disable pulse is generated from the start output control signal after a predetermined time from a time when power is applied to the liquid crystal display.

14. The rush current preventing circuit according to claim 11, wherein the start output control signal generator includes:

a counter for setting a width of the disable pulse; and an arithmetic unit coupled to the counter for generating a logical signal from an output of the counter.

15. The rush current preventing circuit according to claim 14, wherein the counter includes an R-C integrator having resistors and capacitors.

16. The rush current preventing circuit according to claim 11, wherein the output control signal switch allows the start output control signal from the start output control signal generator to be applied to the gate drive circuit during a time interval when the start output control signal has the disable pulse.

17. The rush current preventing circuit according to claim 11, wherein the output control signal switch allows the output control signal from the output control signal generator to be transferred to the gate drive circuit during a time interval when the start output control signal has the disable pulse.

18. The rush current preventing circuit according to claim 11, wherein the output control signal switch allows the start output control signal from the start output control signal generator to be applied to the gate drive circuit during a time interval when the start output control signal has the disable pulse; and the output control signal switch allows the output control signal from the output control signal generator to be transferred to the gate drive circuit during a time interval when the start output control signal has the disable pulse.

19. The rush current preventing circuit according to claim 1, wherein the output control signal generator, the start output control signal generator, and the output control signal switch are included in a timing controller of the liquid crystal display.

20. A rush current preventing circuit for a liquid crystal display having disable gate drive circuits, comprising:

an output enable signal generator generating an output enable signal to control outputs of the gate drive circuits;

a start output enable signal generator generating a start output enable signal having an interval of disable pulse at a time of applying an initial power; and an output enable signal switch coupled to the output enable signal generator and the start output enable signal generator, the output enable signal switch controlling the output enable signal and the start output enable signal in accordance with the start output enable signal.

21. The rush current preventing circuit as claimed in claim 20, wherein the disable pulse has a width of about 20 ms.

22. The rush current preventing circuit as claimed in claim 20, wherein the output enable signal generator, the start output enable signal generator, and the output enable signal switch are included in a timing controller of the liquid crystal display.

23. A rush current preventing circuit for a liquid crystal display having a timing controller for applying a start pulse and an output enable signal to drive gate drive integrated circuits, comprising:

start output enable signal generator generating a start output enable signal having an interval of disable pulse at a time of applying an initial power; and an output enable signal combining unit coupled to the start output enable signal generator and combining the output enable signal with the start output enable signal to produce a combined output enable signal, the output enable signal combining unit applying the combined output enable signal to the gate drive integrated circuits.

24. The rush current preventing circuit as claimed in claim 23, wherein the start output enable signal generator includes:

an integrator for integrating a row drive clock; and a comparing device for generating a logical signal from an output of the integrator.

25. The rush current preventing circuit as claimed in claim 23, wherein the comparing device includes a switching device having a predetermined threshold voltage.

26. The rush current preventing circuit as claimed in claim 23, wherein the output enable signal combining unit includes a logical sum gate.

27. The rush current preventing circuit as claimed in claim 23, wherein the disable pulse has a width of about 20 ms.

* * * * *